United States Patent [19]

Bentley

[11] 4,381,177

[45] Apr. 26, 1983

[54] SONIC PRESSURE WAVE SURFACE OPERATED PUMP

[76] Inventor: Arthur P. Bentley, P.O. Box 1952, Roswell, N. Mex. 88201

[21] Appl. No.: 253,317

[22] Filed: Apr. 13, 1981

Related U.S. Application Data

[63] Continuation-in-part of Ser. No. 160,934, Jun. 19, 1980, Pat. No. 4,341,505, which is a continuation-in-part of Ser. No. 958,552, Nov. 8, 1978, Pat. No. 4,259,799.

[51] Int. Cl.[3] ..... F04F 7/00

[52] U.S. Cl. ..... 417/240; 417/378

[58] Field of Search ..... 417/240, 241, 377, 378, 417/383

[56] References Cited

FOREIGN PATENT DOCUMENTS 1041371 10/1978 Canada ..... 417/383

*Primary Examiner*—Leonard E. Smith

*Attorney, Agent, or Firm*—Herbert E. Haynes, Jr.

[57] ABSTRACT

A single tube surface operated pump including a piston reciprocally mounted in a cylinder for alternately opening and closing a liquid delivery port formed in the side of the cylinder and for generating a sonic pressure wave by impacting a column of liquid contained in a metallic tube extending from the cylinder to a remote pumping mechanism located in communication with the liquid to be pumped. The piston is especially configured with a central recess in the face thereof so that the sonic pressure waves generated thereby will pass through a sonic pressure wave swirl chamber and move toward the pumping mechanism in a spiral-like motion against the inner wall of the metallic tube and enter into a sonic intensifier chamber where they are reflected off the pumping mechanism into a central column which travels back toward the cylinder and causes the fluid to be pumped to move in that same direction.

19 Claims, 4 Drawing Figures

SONIC PRESSURE WAVE SURFACE OPERATED PUMP

CROSS-REFERENCE TO RELATED PATENT APPLICATION

This application is a continuation-in-part of a copending U.S. patent application, Ser. No. 160,934, filed June 19, 1980, now U.S. Pat. No. 4,341,505, for: SONIC PRESSURE WAVE PUMP FOR LOW PRODUCTION WELLS, which is in turn a Continuation-in-Part of application Ser. No. 958,552, filed Nov. 8, 1978, for SONIC PRESSURE WAVE SURFACE OPERATED PUMP which issued as U.S. Pat. No. 4,259,799, on Oct. 20, 1981, all filed by the same inventor.

BACKGROUND OF THE INVENTION

1. Field of the Invention

This invention relates to pumps and more particularly to an improved sonic pressure wave surface operated pump.

2. Description of the Prior Art

It is well known to provide a pumping mechanism at an underground level to pump liquid from that level to the surface, with such a down hole pump being operated by a surface located mechanism which reciprocally impacts a column of liquid contained within a tube that communicates between a surface located mechanism and the down hole pump. The surface located mechanism, in addition to impacting the column of liquid, is reciprocally operated to alternately open and close a liquid delivery port. The impaction of the standing column of liquid produces hydraulic pressure waves that are transmitted by the liquid to the down hole pump to impart a reciprocal movement thereto. The down hole pump includes a plunger, or similar mechanism, which is biased upwardly by suitable springs, and has a central passage formed axially therethrough with a one-way check valve located in the lowermost end of the passage. When the hydraulic pressure waves move the plunger down against the spring bias, the check valve opens to admit the liquid being pumped into the passage, and the subsequent upstroke of the plunger closes the check valve and causes a general upward movement of the standing column of liquid with the uppermost portion thereof exiting through the fluid delivery port formed in the surface located mechanism.

Examples of the above described pumping mechanisms, and others which operate on that same basic principle, are fully disclosed in U.S. Pat. Nos.: 2,379,539, 2,355,618, 2,572,977, 2,751,848 and 3,277,831.

These prior art pumps critically depend upon ideal adjustment of the input frequency relative to the length of the tube in which the standing column of liquid is contained, that is, resonant timing. Further, such prior art pumps are seriously limited in their pumping capacities due to such factors as inertia of the liquid, and the like.

SUMMARY OF THE INVENTION

In accordance with the present invention, a sonic pressure wave surface operated single tube pump is disclosed as including a surface located sonic pressure wave generator from which a metallic tube depends so as to communicate with an undeground, or down hole pumping mechanism that is located at the level of the liquid to be pumped.

The sonic pressure wave generator includes a substantially horizontally disposed cylinder having a liquid delivery port formed in the cylinder's sidewall with the delivery port being coupled to a remotely located liquid receiving reservoir. A piston of special configuration is mounted in the cylinder and is reciprocally operated therein by a suitable drive means, with that reciprocal movement alternately opening and closing the liquid delivery port. Additionally, the reciprocal movement of the piston will cause it to impact a standing column of liquid carried in the metallic tube and extending into the cylinder to produce sonic pressure waves of special character. The liquid impacting face of the piston is formed with a centrally located truncated conical recess or cavity which extends axially into the piston with the inner end of that recess communicating with a blind cylindrical bore formed axially in the piston. Thus, the liquid impacting face of the piston is of ring-like configuration.

Impacting of the standing column of liquid by the piston configured as described above produces sonic pressure waves which pass through a sonic pressure wave swirl chamber and are directed so as to move downwardly along the inner walls of the metallic tube in a spiral-like motion.

The underground, or down hole pumping mechanism which is coupled to the lowermost end of the metallic tube is of generally cylindrical configuration having an axial bore formed therein. The uppermost end of the axial bore is especially configured to form a sonic intensifier chamber which receives the downwardly spiraling sonic pressure waves and causes an increase in the velocity thereof. A plunger is reciprocally mounted in the axial bore of the housing with that plunger having an axial passage formed therethrough with a one-way check valve means located at the lowermost end of that passage. The plunger is biased upwardly by a compression spring which counterbalances the weight of the standing column of liquid. The downwardly spiraling sonic pressure waves, which are increased in velocity in the intensifier chamber, impinge upon the head of the plunger about its periphery thus forcing the plunger down which opens the check valve means and admits the liquid being pumped to the axial passage formed through the plunger. The impinging sonic pressure waves are reflected by the head of the plunger inwardly and upwardly into a column centrally of the metallic tube. This upwardly moving central column will carry the liquid being pumped with it.

The pump of the present invention configured as described above, produces high pump output pressure and velocity, as compared with prior art pumps such as those hereinbefore described, with that output pressure and velocity being considerably higher than could be reasonably expected from a pump which operates upon hydraulic pressures alone. Exactly what takes place in the pump of the present invention is not clearly understood. It is known that the special configuration of the piston and the swirl chamber located in the sonic generator produces the sonic pressure waves of special character and those waves, in conjunction with the sonic intensifier chamber in the down hole pumping mechanism, are responsible for the pump's performance. Exhaustive tests and experiments show that the generated sonic pressure waves move along the inner walls of the metallic tube in a spiral or threadlike motion and those downwardly spiraling waves do not appear to exert any downwardly applied pressure or other force on the liquid in the center of the tube. The downwardly spiraling sonic pressure waves increase in velocity upon entering the sonic intensifier chamber and are reflected inwardly and upwardly as hereinbefore described. The upwardly moving central column of liquid is believed to be augmented with regard to pressure and velocity, by counteraction with the downwardly spiraling waves acting like a worm gear or lead screw to force the central column counter-current to the generated sonic pressure waves.

Accordingly, it is an object of the present invention to provide a new and useful pump.

Another object of the present invention is to provide a new and useful sonic pressure wave surface operated single tube pump.

Another object of the present invention is to provide a new and useful sonic pressure wave surface operated single tube pump having a high pump output pressure and velocity as compared to known pumps.

Another object of the present invention is to provide a new and useful pump of the above described type which includes an aboveground sonic pressure wave generator which is coupled by a metallic tube to an underground pumping mechanism located at the level of the liquid to be pumped.

Another object of the present invention is to provide a new and useful pump of the above described type in which the aboveground sonic pressure wave generator includes a reciprocally operable piston which upon impacting a standing column of liquid contained within the pump will generate sonic pressure waves which pass through a sonic pressure wave swirl chamber and move downwardly along the inner walls of the tube in a spiral motion.

Another object of the present invention is to provide a new and useful pump of the above described character in which the piston operable in the sonic pressure wave generator has a truncated conical recess formed centrally in its liquid impacting face with that recess opening into a blind cylindrical bore formed axially in the piston.

Another object of the present invention is to provide a new and useful pump of the above described character in which the underground pumping mechanism is provided with a sonic intensifier chamber for receiving the sonic pressure waves from the metallic tube and increasing the velocity thereof.

Still another object of the present invention is to provide a new and useful pump of the above described character in which the underground pumping mechanism includes a plunger which is reciprocally operated by the sonic pressure waves to accomplish a pumping action, with the pressure waves impinging on the plunger and being reflected inwardly and upwardly therefrom to provide an upwardly moving central column of liquid in the metallic tube, with that central column of liquid carrying the liquid being pumped with it to the surface.

The foregoing objects of the present invention, as well as the invention itself, may be more fully understood from the following description when read in conjunction with the accompanying drawings.

DESCRIPTION OF THE PREFERRED EMBODIMENT

Figures 1, 2:
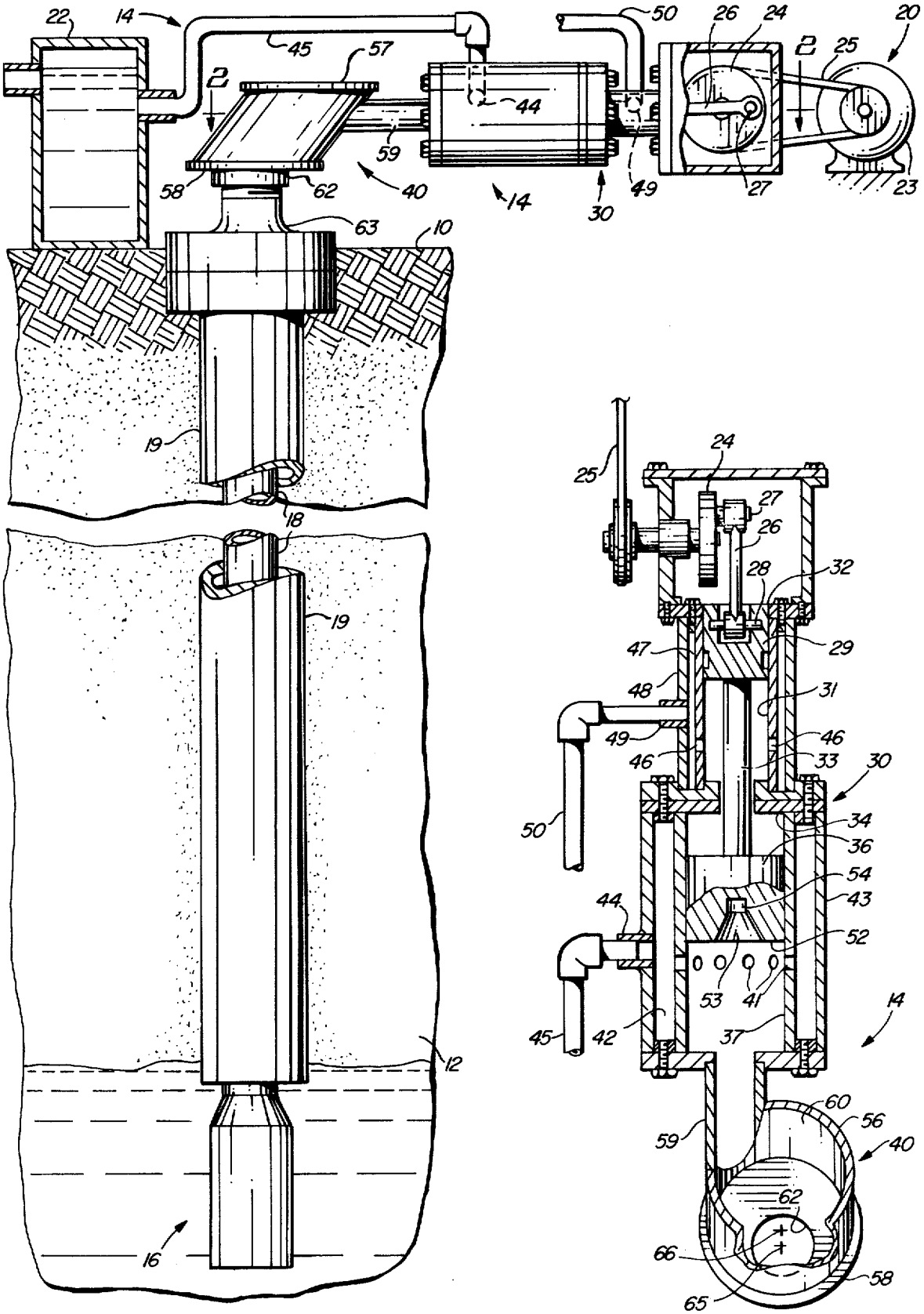
FIG. 1 is a section through a ground formation and illustrating the sonic pressure wave surface operated pump of the present invention in elevation within that ground formation.
FIG. 2 is an enlarged sectional view taken along the line 2—2 of FIG. 1.

Referring more particularly to the drawings, FIG. 1 illustrates a ground formation having a surface level 10 and an underground level 12 containing liquid which is to be pumped, such as water, oil, and the like. The sonic pressure wave surface operated pump of the present invention is seen to be located in the ground formation in a conventional manner, and the pump includes, as will hereinafter be described in detail, an aboveground sonic pressure wave generator, which is identified in its entirety by the reference numeral 14, an underground pumping mechanism which is indicated generally by the reference numeral 16, and an interconnecting metallic tube 18.

It will be noted that in accordance with standard practices, particularly in the oil well art, the bore formed in the ground formation may be lined with a suitable casing 19.

FIG. 1 also illustrates a drive means 20 for operation of the above ground sonic pressure wave generator 14, and a reservoir 22 for receiving the liquid pumped by the pump of the present invention.

The drive means 20 may be any of several well known mechanisms, and is shown for illustrative purposes as including an electric motor 23 which rotatably drives a fly wheel 24 such as by means of a suitable pulley-drive belt arrangement 25. A crank arm 26 is connected on one of its ends by a pivot pin 27 eccentrically mounted on the fly wheel 24 and has its other end connected by a wrist pin 28 (FIG. 2) to a drive piston 29 reciprocally mounted in the sonic pressure wave generator 14. In this manner, the drive means 20 which is a rotatably driven mechanism, will supply reciprocal movement to the sonic pressure wave generator 14 as will hereinafter be described.

Figure 3:
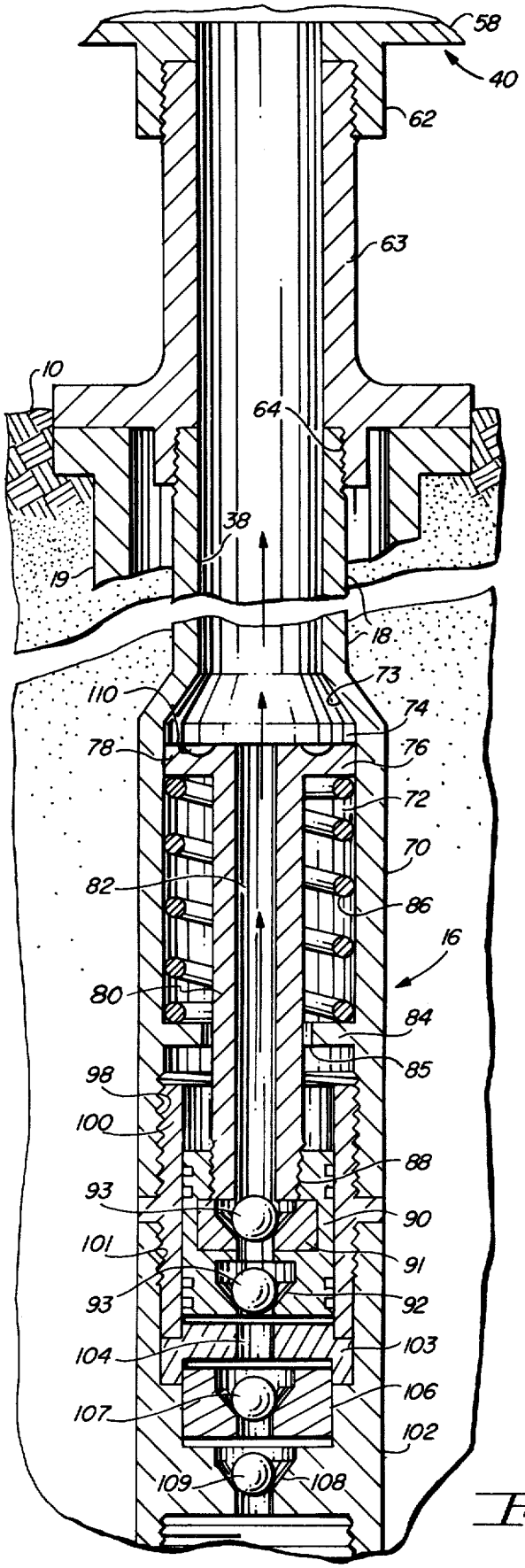
FIG. 3 is an enlarged vertical section taken through the sonic pressure wave surface operated pump of the present invention and illustrating the operational position of that pump when the fluid impacting piston thereof is in its backstroke position.
Figure 4:
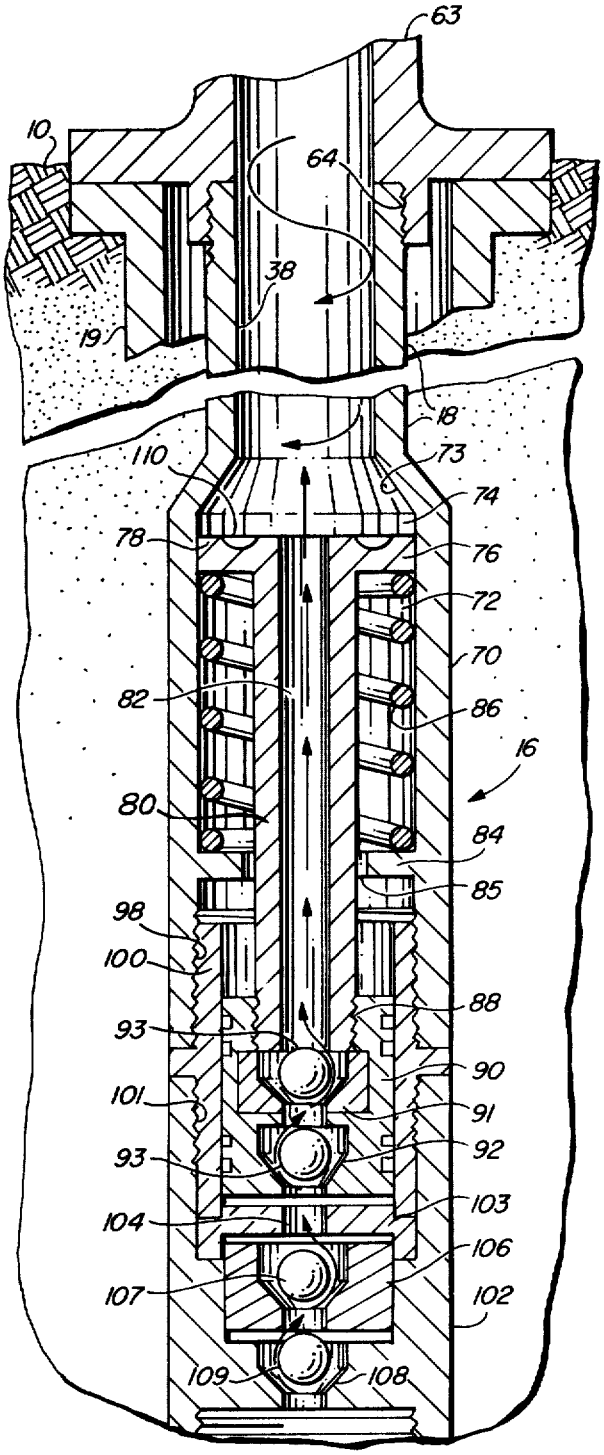
FIG. 4 is a view similar to FIG. 3 and showing the sonic pressure wave surface operated pump in a second operation position when the fluid impacting piston thereof is in its impacting position.

Referring more particularly to FIG. 2, the sonic pressure wave generator 14 includes a generally cylindrical housing 30 having a first axial bore 31 in which the drive piston 29 is reciprocally mounted, with that bore having an open end 32 through which the crank arm 26 extends for connecting the drive piston to the drive means 20. A piston rod 33 extends axially from the drive piston 29 through a divider or partition wall 34 and a fluid impacting piston 36 is fixedly mounted on the other end of the piston rod, with the fluid impacting piston 36 being reciprocally mounted in a second axial bore 37 formed axially in the cylindrical housing 30. The second axial bore 37 of the cylindrical housing 30 is at least partially open on its other end so that the second axial bore is in communication with the bore 38 (FIG. 3) of the metallic tube 18 with this communication being accomplished through a sonic pressure wave swirl chamber 40 which is part of the sonic pressure wave generator and which physically couples the sonic pressure wave generator 14 to the metallic tube 18 as will hereinafter be described in detail.

The second axial bore 37 is provided with a circular array of apertures 41 formed through the sidewall thereof so that the bore 37 communicates with an annular collection chamber 42 formed by a jacket 43 so as to circumscribe the second bore 37. The circular array of apertures 41 collectively form a fluid delivery port through which pumped fluid is delivered into the annular collection chamber 42 and is subsequently directed through an output port 44 formed on the jacket 43 for delivery to the reservoir 22 via a conduit 45 in a manner which will become apparent as this description progresses.

The first axial bore 31, in which the drive piston is reciprocally mounted, is similarly configured in that it is provided with a suitable array of apertures 46 formed through its sidewall which places the bore 31 in communication with an annular chamber 47 formed by a jacket 48, which is provided with an output port 49 having a suitable conduit 50 connected thereto.

The fluid delivery port (apertures 41) and the collection chamber 42 provided for the second axial bore 37 is employed for delivery of the pumped fluid as hereinbefore mentioned, and the apertures 46 in conjunction with the annular chamber 47 of the first axial bore 31 are provided for leakage collection and disposal purposes. In other words, any fluid leaking past the fluid impacting piston 36 into the first axial bore 31 will be collected and directed to a suitable disposal point via conduit 50.

The especially configured fluid impacting piston 36 includes a cylindrical body fixedly carried on the piston rod which, as hereinbefore mentioned, integrally connects the fluid impacting piston 36 and the drive piston 29 so that they are reciprocally movable in unison by the drive means 20. The fluid impacting face 52 of the special piston 36 has a truncated conical cavity, or recess 53 formed axially therein with the inner end of that cavity being in communication with a blind cylindrical bore or socket 54 formed axially in the piston. Thus, the fluid impacting face 52 of the piston 36 is of ring-like configuration.

The sonic pressure wave swirl chamber 40 by which the sonic pressure wave generator 14 is coupled to the metallic tube 18 includes a housing 56 which is configured in the shape of an oblique circular cylinder having a top plate 57 and a bottom plate 58 which lie in parallel planes and are fixedly attached to the housing such as by welding. A conduit 59 is attached to the housing 56 adjacent the top plate 57 and is tangentially disposed with respect to the housing, in other words, the axis of the conduit 59 is offset with respect to the axis of the housing 56 so that those axes do not intersect. The conduit 59 is connected to the cylindrical housing 30 so that the second axial bore 37 of the cylinder 30 is in communication with the bore 60 of the swirl chamber 50. Means in the perferred form of an internally threaded boss 62 is dependingly formed in the bottom plate 58 of the swirl chamber 40 and a coupling conduit 63 is connected to the boss so as to depend therefrom into mounted engagement with the downhole casing 19. The depending end of the coupling conduit 63 is internally threaded as at 64, and the upper end of the metallic tube 18 is threadingly connected thereto so that the bore 60 of the sonic pressure wave swirl chamber 40 is in communication with the bore 38 of the metallic tube 18.

It will be noted that in some instances the coupling conduit 63 may be omitted and in such cases the upper end of the metallic tube 18 is threadingly attached directly to the depending boss 62 of the swirl chamber (not shown).

It has been found that the function of the swirl chamber 40, as will hereinafter be described, is satisfactorily accomplished when the axis 65 (FIG. 2) of the internally threaded depending boss means 62 passes through the center 66 of the bottom plate 58 so that those components are coaxial. However, functioning of the sonic pressure wave swirl chamber 40 is improved when the axis 65 of the boss means 62 is offset from the center 66 of the bottom plate in a direction away from the side of the housing 56 to which the conduit 59 is coupled as shown best in FIG. 2.

A standing column (not shown) of the liquid being pumped is contained in the metallic tube 18 and in the adjacent portions of the sonic pressure wave generator 14 so that reciprocal movement of the fluid impacting piston 36 will cause the piston to impact the standing column of liquid which, due to the special configuration of the piston 36 and the sonic pressure wave swirl chamber 40 will generate sonic pressure waves which move downwardly in a spiral-like path against the inner walls which define the bore 38 formed in the tube 18. It will be noted that the fluid impacting stroke of the piston 36 will move the piston so that it covers the apertures 41 to close the liquid delivery port formed in the cylinder housing 30.

The underground, or down hole pumping mechanism 16, may be connected to the bottom end of the metallic tube 18 in any suitable manner with that connection being shown as the mechanism 16 being integral with the tube 18 for illustration purposes. In any case, the underground pumping mechanism 16 includes a housing 70 which is preferably of elongated cylindrical configuration due to the ease of lowering such a housing down through the casing 19. The housing 70 has an axial bore 72 formed therethrough, with that bore being of larger diameter than the bore 38 of the metallic tube 18, and is in axial communication therewith. The transition between the bores 38 and 72 is special in that the transition is accomplished by a truncated conical surface 73 which, in conjunction with the cylindrical area 74 immediately therebelow, defines a sonic intensifier chamber. The sonic intensifier chamber receives the downwardly spiraling sonic pressure waves as they emerge from the lower end of the metallic tube 18 and causes those waves to increase in velocity.

A plunger 76 is reciprocally mounted in the bore 72 of the housing 70, with that plunger having a head portion 78 at the upper end of a reduced diameter tubular body or stem 80. The plunger is axially disposed in the bore 72 and has an axial passage 82 formed therethrough so as to open upwardly onto the top surface of the head 78 centrally thereof and to open downwardly at the bottom end of the stem portion 80. The housing 70 is provided with an internal rib 84 which lies in a plane transverse to the longitudinal axis of the bore 72, and that rib has an opening 85 formed therethrough so as to be coaxial with the bore. A compression spring 86 is interposed between the downwardly facing surface of the head 78 and the upwardly facing surface of the rib 84. The spring 86 is specifically designed for each installation of the pump of the present invention so that the spring will substantially counterbalance the weight of the standing column of liquid in the metallic tube 18.

The lower end of the stem 80 of the plunger 76 extends through the opening 85 of the rib 84 and has external threads 88 formed thereon by which a check valve body 90 is threadingly attached. The body 90 has an axial bore formed therethrough with spacedly arranged vertically aligned valve seats 91 and 92 formed therein. A ball valve 93 is positioned in each of those valve seats, with those ball valves and their respective valve seats constituting a bleed valve assembly by which occluded air or other gas in the liquid being pumped is prevented from reaching the axial passage 82 of the plunger 76. In many instances, such a bleed valve assembly will not be an absolute requirement.

The lower end of the housing 70 is provided with internal threads 98 with the externally threaded upper end of a nipple 100 threadingly secured therein. The externally threaded lower end of the nipple 100 is threadingly attached to the internal threads 101 formed in the upper end of an end fitting 102. The end fitting 102 has a cylinder end wall 103 mounted in its bore immediately below the nipple 100, and that end wall 103 is formed with a central opening 104 which is in axial alignment with the bore of the check valve body 90. A valve seat ring 106 is positioned in the bore of the end fitting 102 below the end wall structure 103, and the valve seat ring 106 has a central passage in which is positioned a ball valve 107. The lowermost end of the fitting 102 is provided with a second valve seat 108 and a ball valve 109 with a central opening extending downwardly therefrom into communication with the liquid to be pumped from the underground level 12 (FIG. 1).

It will be noted that although two ball valves are shown for the air bleed function, and two ball valves are shown at the lowermost end of the down hole pumping mechanism, in many instances, only one such ball vale will be necessary.

Operation

As hereinbefore mentioned, exactly what occurs in the sonic pressure wave surface operated pump of the present invention is not clearly understood. However, extensive testing and experimentation have shown the pump to produce much higher output pressure and velocity than could be reasonably expected from a pump operating on purely hydraulic principles. Those same tests and experiments have lead to the belief that the pump operates in accordance with the following:

With the fluid impacting piston 36 of the aboveground sonic pressure wave generator 14 at the end of its backstroke, the liquid delivery port in the form of the plural apertures 41, is open. When the piston 36 moves in the direction of the swirl chamber 40, i.e. the piston 36 makes its fluid impacting stroke, the piston will close the liquid delivery apertures 41 and will impact the standing column of liquid (not shown) that is contained in the end portion of the axial bore 37 of the housing 30, in the swirl chamber 40, and in the bore 38 of the metallic tube 18. Due to the special configuration of the piston 36, upon impacting the liquid column, it will generate a sonic pressure wave which spirals downwardly about the inner walls of the metallic tube 18 without exerting any appreciable downwardly exerted forces on the central core of the standing liquid column.

Although the function of the sonic pressure wave swirl chamber 40 is not clearly understood, it is thought that it enhances operation by accentuating the spiral motion of the sonic pressure waves and increases the velocity thereof.

Upon reaching the lower end of the metallic tube 18, the downwardly spiraling sonic pressure waves emerge therefrom into the sonic intensifier chamber formed in the upper end of the down hole pumping unit 16, and will increase in velocity, and impinge upon the upper surface of the head portion 78 of the plunger 76. Such impingement will drive the plunger downwardly a sufficient amount to unseat the ball valves and admit the liquid being pumped into the axial passage 82 of the plunger. The impinging sonic pressure waves are reflected inwardly and upwardly to form an upwardly moving central column or core in the liquid within the metallic tube 18. This upwardly moving core will carry the liquid admitted to the passage 82 with it thus delivering that liquid to the aboveground sonic pressure wave generator 14 whereupon it will exit through the liquid delivery apertures 41. It is believed that the velocity and pressure of the upwardly moving central column of liquid is augmented by counteraction with the downwardly spiraling sonic pressure waves which act like a worm gear or lead screw that forces the central column countercurrent to the sonic pressure waves.

During initial testing of the pump of the present invention the top surface of the head 78 of the plunger 76 was flat, and the pump operated quite well. When the pump was disassembled during one of the routine inspections between tests, an endless groove 110 was machined into the previously flat top surface, and subsequent tests showed improved pumping capacity without any apparent increase in power consumption.

It will be understood that the rate of rotation of the fly wheel 24, and thus the rate at which the fluid impacting piston 36 reciprocates, is related to the depth of a particular well, and the time it takes the sonic pressure wave to travel the length of the metallic tube 18. The rate of travel of the sonic pressure wave will also depend upon the particular liquid being pumped and the metal of which the tube 18 is fabricated. By way of example, it will be noted that if the tube 18 has a length of approximately 2,500 feet the sonic pressure wave will have a travel rate of approximately 5,000 feet per second, which has been found to be true of many, if not most of the materials under and through which the sonic pressure wave passes, it will take one-half of a second for the downwardly directed sonic pressure wave to engage the head 78 of the plunger 76, and another one-half second for its echo return, making a total time of one second per cycle of the piston 36. This means that the piston 36 would have to reciprocate 60 times per minute. Obviously, the rate of rotation of the fly wheel 24 which causes a cycle of piston reciprocation would vary with wells of different depth to accommodate the time required for a sonic pressure wave to travel downwardly and be reflected upwardly.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A sonic pressure wave surface operated single tube pump for pumping liquid from an underground level to a ground level, said pump containing a column of liquid and comprising:

(a) a sonic pressure wave generator at the ground surface and including,

I. a cylinder having a bore and a liquid delivery port extending radially from said bore, II. a piston reciprocal in said cylinder and movable to open and close said delivery port, said piston having an end face with a central recess therein for reciprocally impacting the column of liquid to produce sonic pressure waves which move through the column of liquid adjacent the periphery thereof;

(b) a sonic pressure wave swirl chamber defining a bore and having a tangential port opening into that bore adjacent one end thereof, said tangential port being in communication with the bore of said cylinder for receiving the sonic pressure waves therefrom and directing them into the bore of said swirl chamber;

(c) an elongated metallic tube connected to said swirl chamber so that its bore is in communication with the other end of the bore of said swirl chamber for receiving the sonic pressure waves therefrom, said tube having its longitudinal axis disposed in angular relationship with respect to the longitudinal axis of said cylinder, said tube extending through the ground formation to the underground level;

(d) said bore of said swirl chamber being of oblique cylindrical configuration for angularly altering the movement path of the sonic pressure waves from being coaxial with said cylinder to being coaxial with said tube; and (e) pumping mechanism means connected to the extending end of said tube and in communication with the underground liquid to be pumped, said pumping mechanism means including a reciprocally operable plunger for impingingly receiving the sonic pressure waves from said tube and reflecting them into a centrally and upwardly moving column which carries the liquid to be pumped to the ground surface.

2. A sonic pressure wave surface operated single tube pump for pumping liquid from an underground level to a ground surface comprising:

(a) a sonic pressure wave generator including,

I. a cylinder housing having a bore for containing liquid in one end portion thereof and having a liquid delivery port means extending laterally from that bore, II. a liquid impacting piston reciprocal in the bore of said cylinder housing for opening and closing the liquid delivery port means thereof and for reciprocally impacting the liquid containable therein, III. said liquid impacting piston having a liquid impacting end face with a central recess formed therein which generates a sonic pressure wave upon impacting the liquid containable in the bore of said cylinder housing;

(b) a sonic pressure wave swirl chamber including,

I. a housing of oblique circular cylindrical configuration having a bore for containing liquid, II. a top plate for closing one end of said oblique circular cylindrical housing, III. a conduit connected between said oblique circular cylindrical housing and said cylinder housing to place the bore of said oblique circular cylindrical housing in communication with the one end of the bore of said cylinder housing, said conduit being disposed adjacent said top plate and tangential with respect to said oblique circular cylindrical housing, IV. a bottom plate for closing the other end of said oblique circular cylindrical housing;

(c) a metallic tube having a bore for containing liquid and having one end connected to said bottom plate with the bore of said metallic tube being in communication with the bore of said oblique circular cylindrical housing so that the sonic pressure waves generatable in said cylinder housing will pass through said sonic pressure wave swirl chamber and be received and transmitted in the bore of said metallic tube; and (d) pumping mechanism means connected to the other end of said tube and in communication with the liquid to be pumped, said pumping mechanism means including a reciprocally operable plunger for impingingly receiving the sonic pressure waves when transmitted by said tube and reflecting those waves into a centrally and upwardly moving column.

3. A sonic pressure wave surface operated single tube pump as claimed in claim 2 and further comprising a liquid reservoir at the ground surface for containing liquid the same as the liquid to be pumped, said reservoir connected to the liquid delivery port means of said cylinder housing.

4. A sonic pressure wave surface operated single tube pump as claimed in claim 2 wherein the central recess formed in the liquid impacting end face of said piston is of truncated conical configuration.

5. A sonic pressure wave surface operated single tube pump as claimed in claim 2 wherein the central recess formed in the liquid impacting end face of said piston is of truncated conical configuration which communicates with a blind cylindrical bore formed axially in said piston.

6. A sonic pressure wave surface operated single tube pump as claimed in claim 2 wherein the liquid impacting end face of said piston is of ring-like configuration with the central recess thereof being of truncated conical configuration which communicates with a blind cylindrical bore formed axially in said piston.

7. A sonic pressure wave surface operated single tube pump as claimed in claim 2 wherein said bottom plate has means formed therein for coupling said metallic tube to said oblique circular cylindrical housing, said means being formed in said bottom plate offset with respect to the center of said bottom plate in a direction which is opposite to that of the tangential connection of said conduit to said oblique circular cylindrical housing.

8. A sonic pressure wave surface operated single tube pump as claimed in claim 2 wherein said pumping mechanism means comprises:

(a) a housing having a bore for containing liquid and which communicates with the bore of said tube for receiving the sonic pressure waves upon transmission thereof by said tube, said housing having a lower end wall with a passage formed therethrough which communicates with the liquid to be pumped;

(b) said bore of said housing being of larger diameter than the bore of said tube and configured at its lower end to form a sonic intensifier chamber for increasing the velocity of the sonic pressure waves upon receipt thereof;

(c) a one-way check valve in the passage formed in the end wall of said housing;

(d) said plunger is reciprocally mounted in the bore of said housing and has a head from which a reduced diameter stem depends, said plunger having a passage formed axially therethrough;

(e) biasing means in the bore of said housing and bearing against said plunger to bias said plunger upwardly so as to counterbalance the weight of the liquid containable in said tube and in said sonic pressure wave swirl chamber, and in the one end portion of said cylinder housing; and (f) said plunger having a substantially flat upper surface for reflecting the sonic pressure waves which impinge thereon.

9. A sonic pressure wave surface operated single tube pump as claimed in claim 8 wherein the sonic intensifier chamber formed at the upper end of said housing comprises a truncated conical surface which forms the transition between the bore of said metallic tube and the bore of said housing.

10. A sonic pressure wave surface operated single tube pump as claimed in claim 8 wherein the substantially flat upper surface of said plunger is provided with an endless groove formed therein.

11. In a sonic pressure wave surface operated single tube pump for pumping liquid from an underground level to a ground surface comprising:

(a) a liquid reservoir at the ground surface for containing liquid the same as the liquid to be pumped;

(b) a sonic pressure wave generator including,

I. a cylinder having a bore with a liquid delivery port extending laterally from the bore and in communication with said reservoir, II. a piston reciprocal in said cylinder and movable into positions opening and closing said port, III. said piston having an end face which engages liquid in the cylinder and which is formed with a central recess which generates a sonic pressure wave upon impact of said end face with the liquid;

(c) a sonic pressure wave swirl chamber including,

I. a housing of oblique circular cylindrical configuration and having a bore,

II. a top plate for closing one end of said oblique circular cylindrical housing, III. a conduit connected between said oblique circular cylindrical housing and said cylinder to place the bore of said oblique circular cylindrical housing in communication with the bore of said cylinder, said conduit being disposed adjacent said top plate and tangential with respect to said oblique circular cylindrical housing, IV. a bottom plate for closing the other end of said oblique circular cylindrical housing;

(d) power operating means for reciprocating said piston in said cylinder;

(e) a metallic tube having a bore and connected to said bottom plate so that the bore of said metallic tube is in communication with the bore of said oblique circular cylindrical housing, said metallic tube extending through the ground formation to the underground level;

(f) a pumping mechanism at said underground level including,

I. a housing having a bore with its upper end connected to said tube and having a lower end wall formed with a passage communicating with the liquid in the power level, II. a one-way check valve in said passage, III. a plunger reciprocal in said housing and including a head from which depends a reduced diameter stem providing a passage through said plunger, IV. an internal rib in the bore of said housing, V. a compression spring interposed between said rib and the head of said plunger and exerting a force which counterbalances the weight of a column of liquid in said tube; and (g) said plunger head having a substantially flat upper surface for reflecting sonic pressure waves coming downwardly along the inner surface of said tube inwardly and upwardly to move liquid upwardly through said tube and said sonic pressure wave swirl chamber to said sonic pressure wave generator and through said liquid delivery port when the latter is open.

12. The sonic pressure wave surface operated single tube pump of claim 11 in which the recess in the end face of said piston is defined by a flat annular ring-like surface, a truncated conical surface opening onto said ring-like surface and a cylindrical end socket communicating with the small end of said truncated conical surface.

13. The sonic pressure wave surface operated single tube pump of claim 11 wherein said metallic tube is of steel.

14. The sonic pressure wave surface operated single tube pump of claim 11 in which said housing is connected to the lower end of said metallic tube by a truncated conical transition wall.

15. The sonic pressure wave surface operated single tube pump of claim 11 in which said power operated means includes a fly wheel, a crank arm connected to said fly wheel and means for connecting said crank arm and said piston.

16. The sonic pressure wave surface operated single tube pump of claim 11 together with a bleed valve at the lower end of said plunger.

17. The sonic pressure wave surface operated single tube pump of claim 11 in which there are a pair of aligned one-way check valves at the lower end of the cylinder and which communicate with the liquid in the underground level.

18. The sonic pressure wave surface operated single tube pump of claim 11 wherein said bottom plate has means therein for coupling said metallic tube to said oblique circular cylindrical housing, said means is formed in said bottom plate offset with respect to the center of said bottom plate in a direction which is opposite to that of the tangential connection of said conduit to said oblique circular cylindrical housing.

19. The sonic pressure wave surface operated single tube pump of claim 11 wherein the substantially flat upper surface of said plunger is provided with an endless groove formed therein.

* * * * *